US008578517B2

(12) United States Patent
Alaniz et al.

(10) Patent No.: US 8,578,517 B2
(45) Date of Patent: Nov. 12, 2013

(54) ATHLETIC GARMENT

(76) Inventors: Irma P. Alaniz, Corpus Christi, TX (US); Pedro M. Alaniz, III, Corpus Christi, TX (US)

( * ) Notice: Subject to any disclaimer, the term of this patent is extended or adjusted under 35 U.S.C. 154(b) by 300 days.

(21) Appl. No.: 12/661,509

(22) Filed: Mar. 17, 2010

(65) Prior Publication Data

US 2010/0218300 A1 Sep. 2, 2010

Related U.S. Application Data

(63) Continuation of application No. 11/170,012, filed on Jun. 29, 2005, now abandoned.

(51) Int. Cl.

| | |
|---|---|
| ***A41B 1/00*** | (2006.01) |
| ***A41B 1/08*** | (2006.01) |
| ***A41D 27/10*** | (2006.01) |

(52) U.S. Cl.

USPC ..... 2/115; 2/125

(58) Field of Classification Search

USPC ..... 2/77, 92, 115, 125, 270, 275, 88, 85, 2/93, 87, 69, 106, 113, 114

See application file for complete search history.

(56) References Cited

U.S. PATENT DOCUMENTS

| | | | | |
|---|---|---|---|---|
| 1,508,834 | A | | 9/1924 | Cohen |
| 2,012,206 | A | | 8/1935 | Swint |
| 2,035,377 | A | | 3/1936 | Redmond |
| 2,312,609 | A | | 3/1943 | Warshaw |
| 2,527,258 | A | * | 10/1950 | Kahn ..... 40/586 |
| 2,839,756 | A | | 6/1958 | Gelss |
| 2,941,210 | A | | 6/1960 | Bren |
| 2,943,330 | A | | 7/1960 | Clyne |
| 2,986,740 | A | | 6/1961 | Schudson |
| 3,013,276 | A | | 12/1961 | Maxwell |
| 3,078,699 | A | | 2/1963 | Huntley |
| 3,744,052 | A | | 7/1973 | Rector |
| 4,249,268 | A | | 2/1981 | Berler |
| 4,473,908 | A | | 10/1984 | Knecht |
| 4,649,573 | A | | 3/1987 | Yen |
| 4,698,849 | A | | 10/1987 | Mitchell |
| 5,090,060 | A | | 2/1992 | Gates |
| 5,105,478 | A | | 4/1992 | Pyc |
| 5,159,718 | A | | 11/1992 | Moyer |
| 5,168,580 | A | | 12/1992 | Foo |
| 5,210,877 | A | | 5/1993 | Newman |
| 5,263,923 | A | | 11/1993 | Fujimoto |
| 5,367,708 | A | | 11/1994 | Fujimoto |
| 5,383,235 | A | | 1/1995 | Peters |
| 5,431,030 | A | | 7/1995 | Ishizaki |
| 5,659,895 | A | | 8/1997 | Ford |
| 5,957,878 | A | | 9/1999 | Gilliam |

(Continued)

*Primary Examiner* — Amber Anderson

(74) *Attorney, Agent, or Firm* — G. Turner Moller

(57) ABSTRACT

In several embodiments, an athletic garment is designed to store energy when a weight or load is lowered in order to assist the wearer to subsequently raise the load. In some embodiments, the garment provides seams which are curved in order to twist the garment fabric and thereby store energy therein. In one shirt embodiment, the sleeves extend perpendicularly forward of the torso and then converge toward a centerline of the shirt. In a second shirt embodiment, the sleeves extend perpendicularly forward of the torso for their entire length. In a weight lifter's suit embodiment, the curved seams extends from an armhole of a torso section to a location under the buttocks of the lifter. In another shirt embodiment, the arms extend forwardly of a vertical plane when the wearer is lying on the back in preparation for an arching bench press movement.

24 Claims, 5 Drawing Sheets

(56) References Cited

U.S. PATENT DOCUMENTS

| | | | |
|---|---|---|---|
| 5,978,966 | A | 11/1999 | Dickers |
| 6,047,405 | A | 4/2000 | Wilkinson |
| 6,186,970 | B1 | 2/2001 | Fuji |
| 6,202,216 | B1 | 3/2001 | Watanabe |
| 6,279,161 | B1 | 8/2001 | Johnston |
| 6,343,381 | B1 | 2/2002 | Sirakova |
| 6,353,934 | B1 | 3/2002 | Tada |
| 6,401,497 | B1 | 6/2002 | Nishiyama |
| 6,421,831 | B1 | 7/2002 | Korff |
| 6,519,781 | B1 | 2/2003 | Berns |
| 6,892,396 | B2 | 5/2005 | Uno |
| 2001/0014981 | A1 | 8/2001 | Fairhurst |
| 2002/0138893 | A1 | 10/2002 | Culhane |
| 2003/0046747 | A1 | 3/2003 | Berns |
| 2003/0051286 | A1 | 3/2003 | Gregg |
| 2004/0016041 | A1 | 1/2004 | Uno |
| 2004/0132367 | A1 | 7/2004 | Rock |
| 2006/0048265 | A1 | 3/2006 | Deadwyler |

* cited by examiner

Fig.7
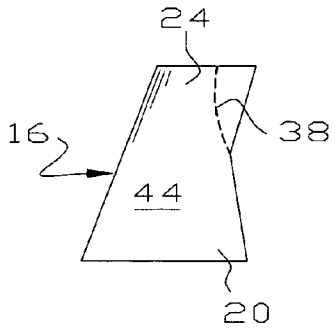
Fig.8
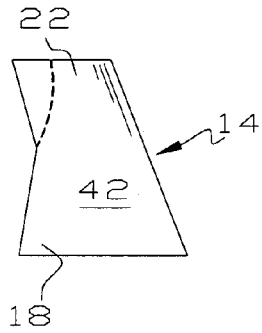
Fig.9
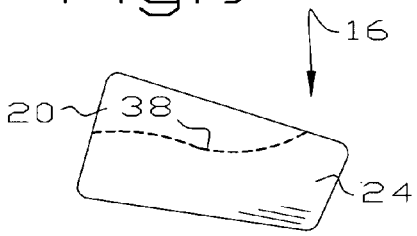
Fig.10
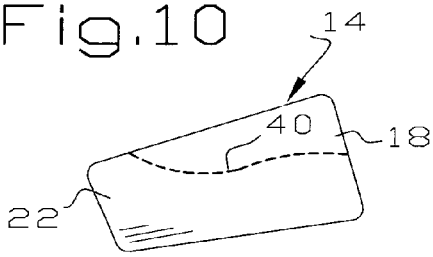
Fig.12
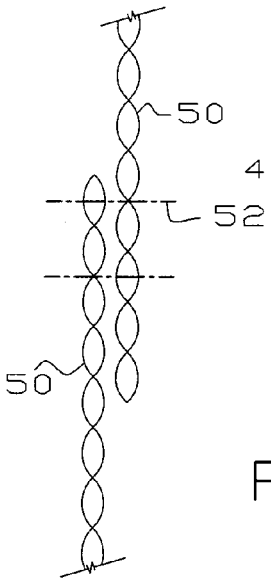
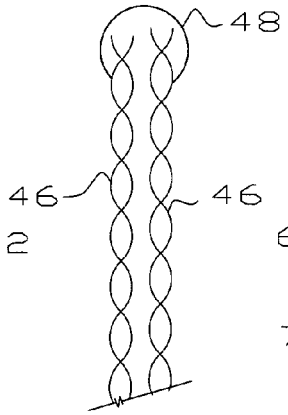
Fig.11
Fig.13
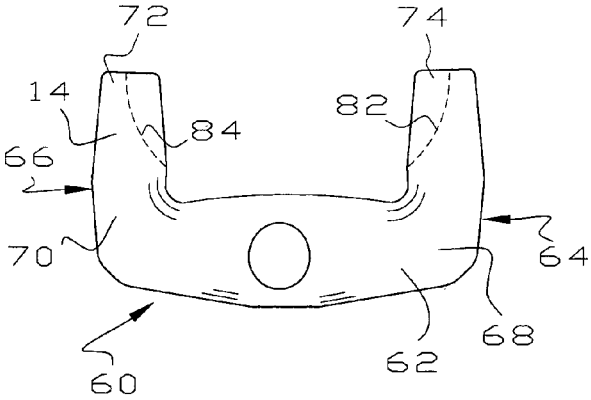

Fig.22
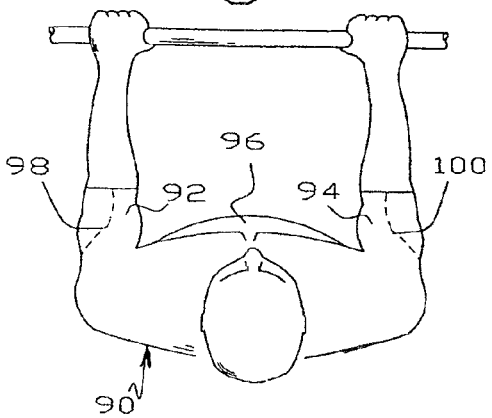
Fig.23
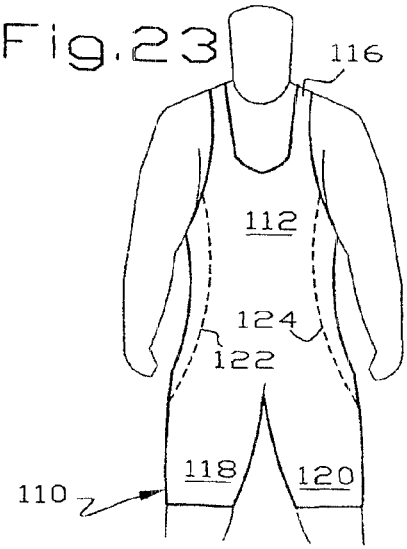
Fig.24
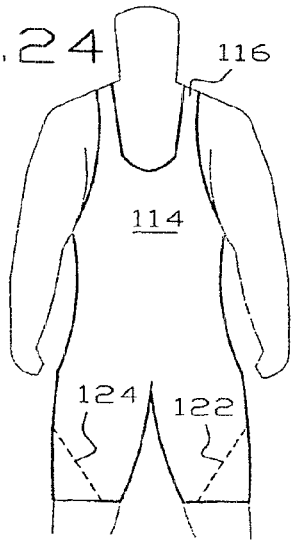
Fig.25
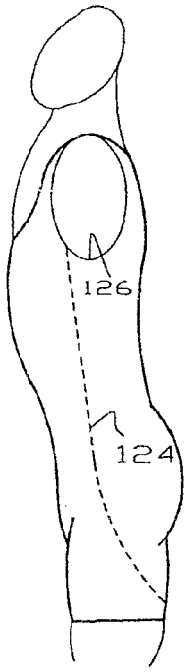
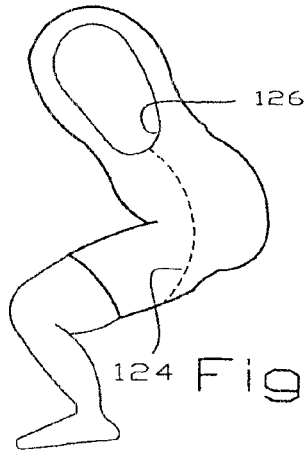
Fig.26

ATHLETIC GARMENT

This application is a continuation of application Ser. No. 11/170,012 filed Jun. 29, 2005 now abandoned.

This invention relates to an athletic garment and more particularly to a garment designed for weight lifters to store energy in the garment so the stored energy may be applied to lifting weights.

BACKGROUND OF THE INVENTION

Weight lifting is a sport, like all sports, where small differences in performance are the difference between winning and losing, especially in top flight competition. The reason, of course, is that competitors are normally very evenly matched. In order to provide a competitive edge, tight fitting weight lifter's shirts have been designed to store energy when a weight is lowered in order to assist the lifter in raising the weight, as shown in U.S. Pat. No. 4,473,908. This approach involves angling the sleeves of a lifter's shirt in a horizontal plane so that the shirt material, across the chest, is stretched on lowering the weight in order to contribute to the lifter's force in raising the weight.

Other disclosures of some interest relative to this invention are found in U.S. Pat. Nos. 4,797,818; 5,636,710; 5,638,646; 5,720,363; 5,816,443; 6,473,739 and Printed Application 2002/001-3730A1.

SUMMARY OF THE INVENTION

In this invention, a tight fitting weight lifter's garment is made so that lowering a weight acts to store energy in the garment so that the stored energy can contribute to the force applied by the lifter in raising the weight. In this invention, the energy storing components are sleeves of a shirt or legs of a weight lifting suit. The sleeves and legs include seams that are curved to twist the garment material and thereby store energy in the fabric of the garment. In some shirt embodiments of this invention an energy storing component comprises sleeves extending away from the shirt torso and then converging.

In the case of curved seams, energy is stored in the garment by twisting the fabric in response to lowering a weight and thereby storing energy in the fabric of the garment. The seams are accordingly curved in a manner to promote twisting of the fabric. In a weight lifting shirt, the seams run in a corkscrew fashion down the sleeves. In a weight lifting suit, the seams run in a curved fashion from adjacent the armhole of the torso covering member to below the buttocks.

In the case of angled sleeves acting as the energy storing component, lowering a weight in a bench press movement causes the sleeves to diverge. This stretches the fabric of the shirt across the lifter's chest thereby storing energy in the shirt.

It will be appreciated that energy storing garments must be carefully designed and executed if they are to be used in weight lifting or other competitions. For example, extraneous material cannot be applied to the interior or exterior of garments. The energy storing components must be incorporated into either the fabric of the garments or the seams of the garment because competition organizers do not allow extraneous materials on competition garments. Similarly, the use of elastic materials in competition garments is prohibited.

It is an object of this invention to provide an athletic garment that stores energy in such a manner that the garment may be used in an athletic event.

A further object of this invention is to provide an improved garment for weight lifters that improves performance.

A more specific object of this invention is to provide an improved weight lifters shirt that stores energy during lowering of a weight to complement the force applied by the lifter.

Another specific object of this invention is to provide a weight lifter's shirt that is particularly suitable for bench press competition.

These and other objects and advantages of this invention will become more apparent as this description proceeds, reference being made to the accompanying drawings and appended claims.

BRIEF DESCRIPTION OF THE DRAWINGS

FIGS. 7 and 8 are top views of the left and right sleeves after sewing assembly;

FIGS. 9 and 10 are views of the left and right sleeves after sewing assembly and after they are sewn to the shirt front, as viewed from the inside of the sleeves, showing the curved seams;

FIGS. 11 and 12 are enlarged cross-sectional views of two seam embodiments;

FIG. 13 is a top view of another embodiment of a weight lifter's shirt of this invention, illustrating the shirt in an unstressed condition, i.e. before the shirt is worn by a user;

FIG. 22 is a top view of a lifter wearing another embodiment of this invention;

FIGS. 23-26 disclose different view of a weight lifter's suit in accordance with this invention;

DETAILED DESCRIPTION

Figure 1:
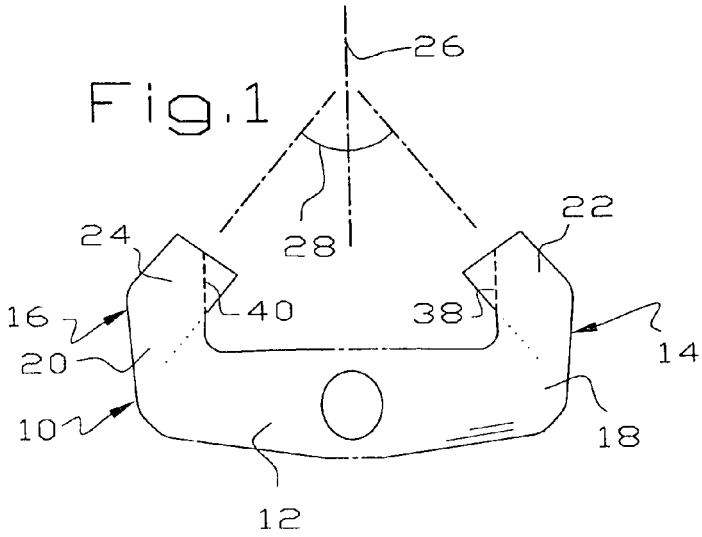
FIG. 1 is a top view of a weight lifter's shirt of this invention, illustrating the shirt in an unstressed condition, i.e. before the shirt is worn by a user, showing a curved seam of the sleeves in a dashed line where the seam is exposed and in a dotted line where the seam is under the sleeve.

Referring to FIGS. 1-12, a weight lifter's shirt 10 comprises a torso section 12 and a pair of sleeves 14, 16 extending away from the torso section 12. Although the energy storing sleeves of this invention may be incorporated into conventional weight lifting shirts or into weight lifting shirts having diverging sleeves, such as shown in U.S. Pat. No. 4,473,908, the sleeves 14, 16 are of unusual design including a proximal segment 18, 20 joined to the torso section 12 and a distal segment 22, 24. The proximal segments 18, 20 are generally perpendicular to the torso section 12 and the distal segments 22, 24 converge toward a centerline 26 and define an angle 28. The angle 28 may vary considerably but is typically in the range of 20-40° and is ideally about 30°. The sleeves 14, 16 are somewhat tapered, meaning that the proximal segments 18, 20 are somewhat larger than the distal segments 22, 24, as seen in FIGS. 5-10.

Figure 2:
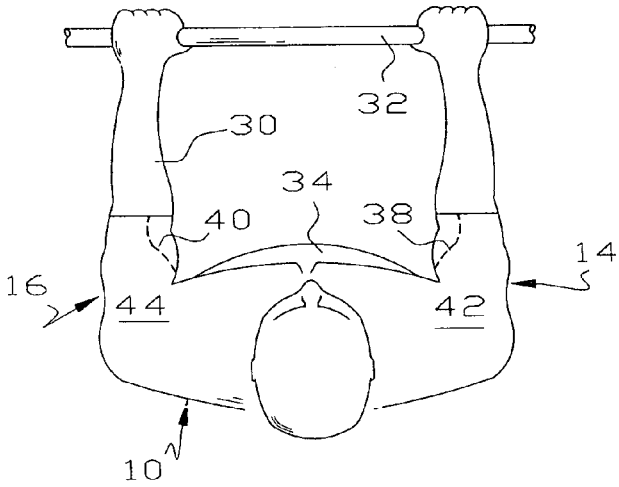
FIG. 2 is a top view of a lifter wearing the shirt of FIG. 1.

Referring to FIG. 2, when a lifter dons the shirt 10, the lifter's arms 30 straighten out the sleeves 14, 16 as shown in FIG. 2. When the lifter lowers a weight 32 in a bench press type movement, the lifter's arms 30 and the sleeves 14, 16 rotate outwardly thereby stressing the fabric in the shirt front 34 across the lifter's chest and thereby storing energy which is available to assist the lifter in raising the weight 32 thereby increasing the weight that can be raised by the lifter. This component of increased lift is caused by the angle of the sleeves 14, 16 and is analogous to the assist provided by the construction shown in U.S. Pat. No. 4,473,908.

An important feature of the shirt 10 is the ability of the sleeves 14, 16 to torque up as the sleeve is stressed, such as in lowering the weight 32 in a bench press motion. To this end, the seams 38, 40 joining the edges of the sleeves 14, 16 is curved in such a manner as to promote twisting of the sleeve fabric 42, 44. To this end, the seams 38, 40 are preferably of a corkscrew shape. Looking axially down the lifter's arms 30 from the shoulder toward the hand, the seam 38 on the right sleeve 14 is clockwise while the seam 40 on the left sleeve 16 is counterclockwise. The reason for this is the seam helps twist the bias of the fabric to help create more resistance and store more energy. In addition, the user may further torque the sleeves by manually twisting the sleeves in the desired direction. In order to promote this twisting of the fabric, the seams should curve for at least 25° around the sleeve, preferably at least 90-180° around the sleeve and ideally about 270° but may be as much as several revolutions.

Figure 6:
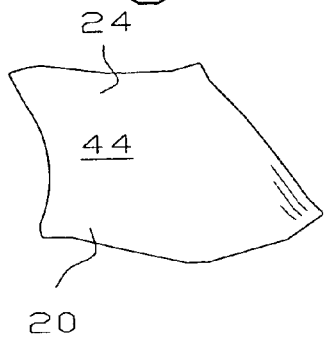
FIGS. 3-6 are patterns of the front, back, left sleeve and right sleeve as cut from fabric in order to make the shirt of FIG. 1.
Figure 5:
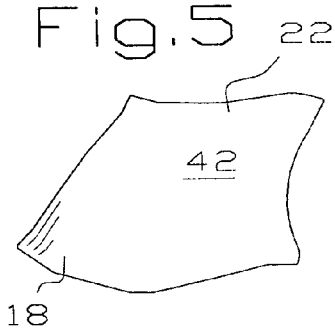
Figure 3:
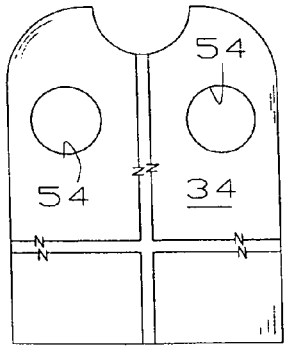
Figure 4:
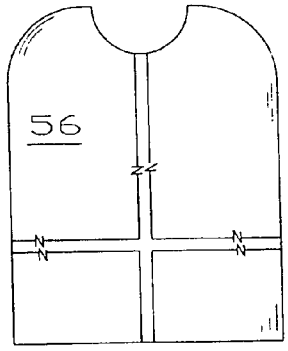
Figure 14:
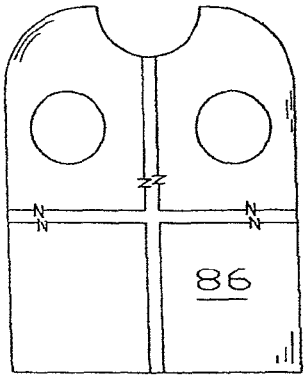
FIGS. 14-17 are patterns of the front, back, left sleeve and right sleeve as cut from fabric in order to make the shirt of FIG. 13.
Figure 15:
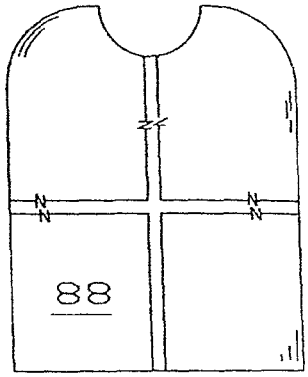

As shown in FIGS. 5 and 6, the material for the sleeves 14, 16 is cut in an unusual manner to produce the curved seams 38, 40. To this end, the edges that will produce the seams 38, 40 are not straight but are curved in an unusual manner.

To assemble the shirt 10, the sleeves 14, 16, the seams 38, 40 are sewn in any conventional manner. One typical seam construction is shown in FIG. 11 where the edge portions 46 coincide and stitching 48 is applied over the ends of the edge portions 46. Another typical seam construction is shown in FIG. 12 where the edge portions 50 overlap and stitching 52 is applied.

After the sleeves 14, 16 are assembled, they are sewn to the torso front 34 in alignment with the arm holes 54 in a conventional manner. Either before or after the sleeves 14, 16 are sewn to the front 34, the front 34 and back 56 are sewn together in a conventional manner.

The fabric of the shirt 10 is preferably a substantially non-elastic material of a suitable weight. As used herein, non-elastic means that the fabric does not stretch more than a few percent. The fabric is preferably, but not necessarily, a polymer fabric, constructed of a heavy denier yarn configured using a warp knit. This configuration provides great strength and durability with the added benefit of making the fabric run resistant. A run is here defined to mean a series of successive raveled loops along one or more adjacent wales of a knitted fabric. Polymer fabrics have a distinct property whereby they give or stretch before complete failure. This is in contrast to most natural fibers, which fail suddenly when stressed to their maximum. This property makes polymer fabrics more dependable, durable and preferable, although not the only operative fabric. The thread of the stitching 48, 50 is of conventional make and is of the same general type material as the polymer of the chosen fabric.

In order for the shirt 10 to be tight fitting on the lifter, the shirt 10 is made in various sizes. By tight fitting, it is meant that the shirt 10 is in a prestressed state that allows for more resistance and a more efficient storage of energy.

In use, when the lifter lowers the weight 32, the shirt 10 undergoes two distinct movements. Because of the orientation of the sleeves 14, 16, the fabric of the shirt front 34 is stretched thereby absorbing energy from lowering of the weight 32, which energy is expended when the lifter raises the weight 32. Because of the curved seams 38, 40, the fabric of the sleeves 14, 16 twists thereby absorbing energy from lowering of the weight 32, which energy is expended when the lifter raises the weight 32. Both of these events contribute to the lifter's ability to raise the weight 32.

Referring to FIGS. 13-21, there is illustrated another embodiment of a weight lifting shirt 60 in accordance with this invention. As shown in FIG. 13, the shirt 60 includes a torso section 62 and a pair of sleeves 64, 66 which extend generally perpendicularly from the torso section 62. The sleeves 64, 66 are somewhat tapered, meaning that the proximal segments 68, 70 are somewhat larger than the distal segments 72, 74 as seen in FIGS. 16-19. As in the embodiment of FIGS. 1-12, the edges 76, 78 of the material 80 are not straight but are curved to produce curved seams 82, 84.

Figure 16:
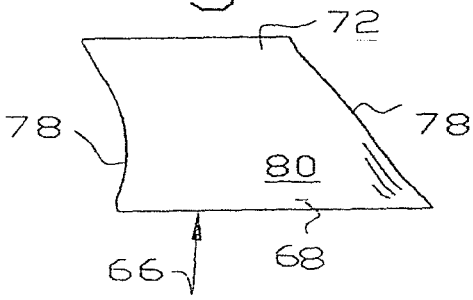
Figure 17:
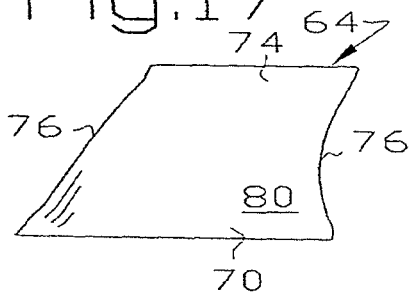
Figure 20:
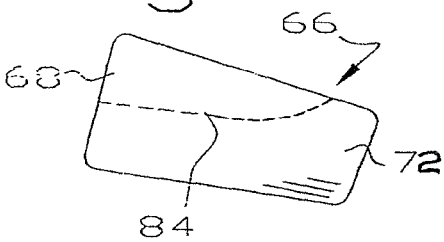
FIGS. 20 and 21 are views of the left and right sleeves of FIGS. 18 and 19 after sewing assembly and after they are sewn to the shirt front, as viewed from the inside of the sleeves, showing the curved seams.
Figure 21:
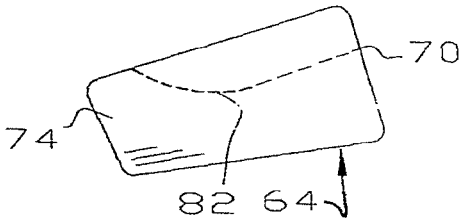
Figure 18:
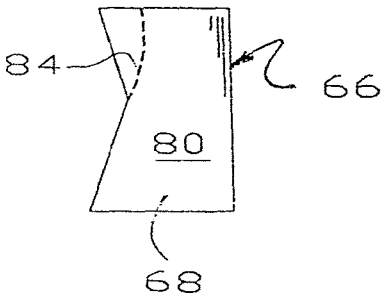
FIGS. 18 and 19 show the left and right sleeves after sewing assembly.
Figure 19:
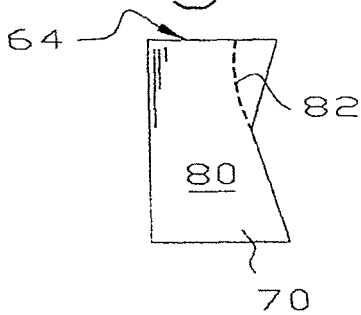

As in the embodiment of FIGS. 1-12, the edges 76, 78 of the sleeve material 80 of FIGS. 16-17 are sewn together to form seams 82, 84 and the sleeves 64, 66 are then sewn to the shirt front 86 and the shirt front 86 and back 88 are sewn together. In use, the shirt 60 functions in a manner similar to the shirt 10.

Referring to FIG. 22, there is illustrated another weight lifting shirt 90 which, in the unstressed condition, may have the sleeves 92, 94 extend perpendicularly to the torso section 96 (as in FIG. 13) or may extend at an angle to the torso section 96 (as in FIG. 1). The shirt 90 differs from the shirts 10, 60 in that the seams 98, 100 are on the outside of the sleeves 92, 94 rather than on the inside. The shirt 90 functions in the same manner as the shirts 10, 60 in the sense that the curved seam twists the bias of the fabric to create more resistance and store more energy.

Referring to FIGS. 23-26, there is illustrated a weight lifting suit 110 comprising a front torso section 112, a back torso section 114 and a pair of straps 116 extending over the shoulders of the lifter and connected to the sections 112. The front and back torso sections 112, 114 are of sufficient length to provide suit legs 118, 120 and are seamed up the crotch and along side seams 122, 124. As shown best in FIG. 25, the seam 124, which is a mirror image of the seam 122, extends downwardly from the forward bottom section of the armhole 126 and then curves rearwardly to the bottom of the legs 118, 120. The curved seams 122, 124 torque up when the lifter squats down thereby providing an assist when the lifter goes to rise.

It will be noted that the curved seams of this invention are generally concave in one direction. This promotes twisting of the fabric of the shirt or suit in contrast to a situation where the seams meander back and forth.

Figure 29:
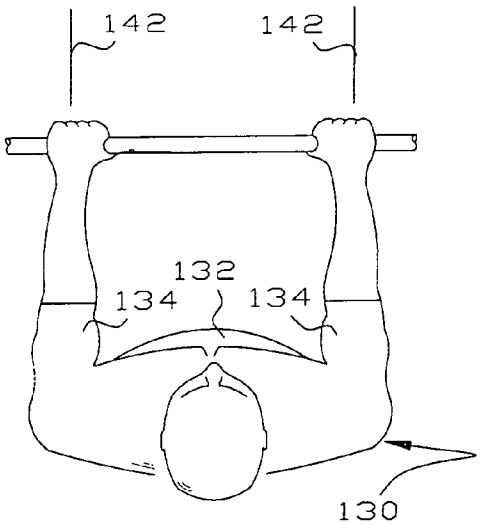
FIG. 29 is an end view of the shirt of FIGS. 27 and 28.
Figure 28:
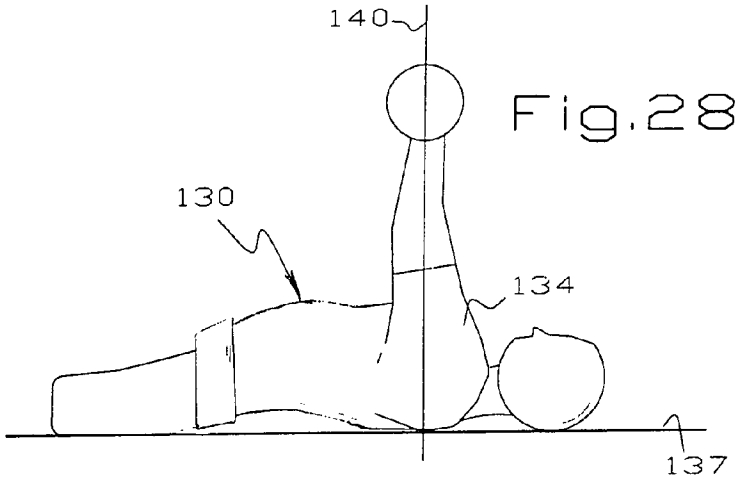
FIG. 28 is a side view of the lifter and shirt of FIG. 27 when the back is arched, preparing for a bench press lift.
Figure 27:
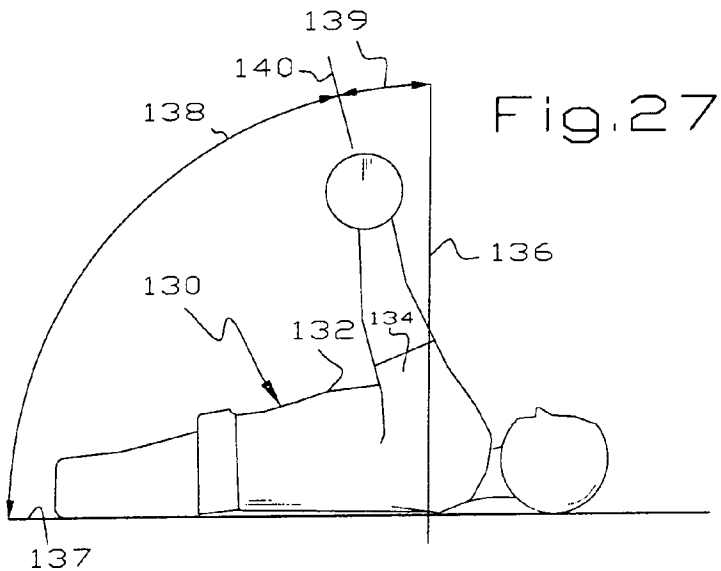
FIG. 27 is a side view of a lifter wearing another shirt of this invention that is particularly suitable for bench press competition.

Referring to FIGS. 27-29, there is illustrated a bench press shirt 130 having a tight fitting torso section 132 providing arms 134 which, in an unstressed condition, extend forwardly of a vertical plane 136 and toward a horizontal underlying surface 137. The angle 138 between an axis 140 of the sleeves 134 and the underlying surface 137 may vary somewhat. Typically, the angle is between 65-80° and is preferably about 75° for reasons more fully apparent hereinafter. Thus, the angle 139 between the axis 140 and the vertical plane 136 is in the range of 10-25° and is preferably about 15°. As shown best in FIG. 29, the arms 134 extend in parallel planes 142 perpendicular to the bench on which the lifter is lying. As will be evident, the seams on the sleeve may either be straight or curved, as in previous embodiments.

One of the techniques of bench press lifting is called arch bending. Rather than the lifter simply lying flat on the bench and raising the weight with the arms, the lifter arches the back as shown by a comparison of FIGS. 27 and 28. The purpose of arching the back is to create a short, efficient upward stroke that allows for more effective utilization of major supportive muscle groups. The disadvantage is that the act of arching, often creates its own problems, namely it makes controlling of the weight more difficult when using conventionally designed supportive shirts.

Control problems become evident when the lifter has to exert substantial effort to keep the bar vertically above its resting place, or as is known in the art, in the groove, as the weight is descending. The type control problem sometimes results in the bar skating off the support, either backward toward the lifter's head or forward toward the lifter's torso. It will be evident that the vertical lifting force that can be exerted by the lifter is reduced by any effort of the lifter to control the horizontal position of the bar. Thus, any reduction in control effort will naturally add to the ability of the lifter to vertically raise the bar.

The problem with prior art lifting shirts, as used in arch bench pressing, is that the lifter must exert effort to counteract the tendency of the sleeves to influence the horizontal position of the bar. In contrast, as shown in FIG. 28, when the lifter arches the back, the sleeves 134 rotate to a position perpendicular to the underlying surface, i.e. the axis 140 of the sleeves 134 becomes vertical or coextensive with the vertical plane 136. Thus, the ideal size of the angle for any particular lifter depends on the extent the lifter can arch the back. Anecdotal evidence is that arch bending lifters are capable of lifting a significantly greater weight using the shirt 130.

Although this invention has been disclosed and described in its preferred forms with a certain degree of particularity, it is understood that the present disclosure of the preferred forms is only by way of example and that numerous changes in the details of operation and in the combination and arrangement of parts may be resorted to without departing from the spirit and scope of the invention as hereinafter claimed.

We claim:

1. An atmospherically open tight fitting weight lifter's shirt comprising; a torso section sized and adapted to fit snugly about the torso of a weight lifter when worn and a pair of sleeves sized and adapted to fit snugly about the arms of a weight lifter when worn projecting from the torso section and defining shoulders and armpits, the sleeves and a front of the torso section between the armpits being made wholly of a non-elastic fabric which cannot stretch substantially, each sleeve having only one layer of material having a proximal edge, a distal edge and a pair of juxtaposed edges, said juxtaposed edges sewn together with inelastic thread defining a seam thereby forming said sleeve into a tubular formation with said seam extending from said proximal edge to said distal edge, said juxtaposed edges having a curvature such that the seam bends around the sleeve for at least about 90°, said torso section in its relaxed flattened state defining a front section, all of which faces in a first direction, and a back section, all of which faces in a second direction opposite to the first direction, said front section defining arm holes, said proximal edges of said sleeves being attached solely to said front section about said arm holes with at least a proximal section of said sleeves projecting away from said front section, whereby when said shirt is worn by a weight lifter lying in a supine position and said weight lifter flexes said sleeves such as by lowering a set of weights from a position above the torso to a position adjacent the torso causing said sleeves to twist, energy is stored in the shirt upon twisting of the fabric of the sleeves, wherein such energy aids the weight lifter to raise the set of weights back to the position above the torso.

2. The weight lifter's shirt of claim 1 wherein the seams are of corkscrew shape.

3. The weight lifter's shirt of claim 2 wherein the seams bend in a corkscrew manner for at least 1800 around the sleeve.

4. The weight lifter's shirt of claim 1 wherein the seams are on the inside of the sleeves.

5. The weight lifter's shirt of claim 1 wherein the seams are on the outside of the sleeves.

6. The weight lifter's shirt of claim 1 wherein each sleeve, when said torso section is in a relaxed flattened condition, comprise a proximal section adjacent the torso section extending perpendicularly away from the torso section, the proximal sections of the sleeves being parallel.

7. The weight lifter's shirt of claim 6 wherein the proximal sections extend perpendicularly away from the torso section to an intermediate location and further comprising each sleeve having a distal section extending from said intermediate location to said distal edge and converging toward each other.

8. The weight lifter's shirt of claim 1 wherein said fabric has a maximum stretch of not more than a few percent.

9. The weight lifter's shirt of claim 1 wherein the torso section is made wholly of a non-elastic fabric which cannot stretch substantially.

10. The weight lifter's shirt of claim 1 wherein the seams curve smoothly around the sleeves.

11. An atmospherically open tight fitting weight lifter's shirt as claimed in claim 1, wherein each sleeve has a length that approximately extends from the torso section to about the elbow of the weight lifter when worn.

12. An atmospherically open tight fitting weight lifter's shirt comprising; a torso section sized and adapted to fit snugly about the torso of a weight lifter when worn and a pair of sleeves sized and adapted to fit snugly about the arms of a weight lifter when worn projecting from the torso section and defining shoulders and armpits, the sleeves and a front of the torso section between the armpits being made wholly of a non-elastic fabric which cannot stretch substantially, each sleeve comprising a tubular structure having only one layer of material having a proximal edge, a distal edge and a pair of juxtaposed edges, said juxtaposed edges sewn together with inelastic thread defining a seam thereby forming said sleeve into said tubular structure with said seam extending from said proximal edge to said distal edge, said juxtaposed edges having a curvature such that the seam bends around the sleeve, said torso section in its relaxed flattened state defining a front section, all of which faces in a first direction, and a back section, all of which faces in a second direction opposite to the first direction, said front section defining arm holes, said proximal edges of said sleeves being attached solely to said front section about said arm holes with at least a proximal section of said sleeves projecting away from said front section, whereby when said shirt is worn by a weight lifter lying in a supine position and said weight lifter flexes said sleeves such as by lowering a set of weights from a position above the torso to a position adjacent the torso causing said sleeves to twist, energy is stored in the shirt upon twisting of the fabric of the sleeves, wherein such energy aids the weight lifter to raise the set of weights back to the position above the torso.

13. The weight lifter's shirt of claim 12 wherein the seams bend in a corkscrew manner around the sleeve for at least about 200.

14. The weight lifter's shirt of claim 12 wherein the seams bend in a corkscrew manner around the sleeve for at least about 900.

15. The weight lifter's shirt of claim 12 wherein the seams bend in a corkscrew manner around the sleeve for at least 1800.

16. The weight lifter's shirt of claim 12 wherein said fabric has a maximum stretch of not more than a few percent.

17. The weight lifter's shirt of claim 12 wherein the torso section is made wholly of a non-elastic fabric which cannot stretch substantially.

18. The weight lifter's shirt of claim 12 wherein the seams curve smoothly around the sleeves.

19. An atmospherically open tight fitting weight lifter's shirt as claimed in claim 12, wherein each sleeve has a length that approximately extends from the torso section to about the elbow of the weight lifter when worn.

20. The weight lifter's shirt of claim 12 wherein each sleeve, when said torso section is in a relaxed flattened condition, comprise a proximal section adjacent the torso section extending perpendicularly away from the torso section, the proximal sections of the sleeves being parallel.

21. A method of lifting weights in a bench press comprising: wearing a tight fitting atmospherically open lifter's shirt comprising a torso section sized and adapted to fit snugly about the torso of a weight lifter when worn and a pair of sleeves sized and adapted to fit snugly about the arms of a weight lifter when worn projecting from the torso section and defining shoulders and armpits, the sleeves and a front of the torso section between the armpits being made wholly of a non-elastic fabric which cannot stretch substantially, each sleeve having only one layer of material having a proximal edge, a distal edge and a pair of juxtaposed edges, said juxtaposed edges sewn together with inelastic thread defining a seam thereby forming said sleeve into a tubular formation with said seam extending from said proximal edge to said distal edge, said juxtaposed edges having a curvature such that the seam bends around the sleeve for at least about 90°, said torso section in its relaxed flattened state defining a front section, all of which faces in a first direction, and a back section, all of which faces in a second direction opposite to the first direction, said front section defining arm holes, said proximal edges of said sleeves being attached solely to said front section about said arm holes with at least a proximal section of said sleeves projecting away from said front section;

lying in a supine position on an underlying surface;

grasping a bar of a barbell with each hand;

lowering the barbell from a first position substantially parallel perpendicular to the underlying surface above the torso to a second position substantially parallel to the underlying surface adjacent the torso;

said lowering comprises flexing and twisting said sleeves to store energy in the shirt upon twisting of the fabric of the sleeves;

raising said barbell to the first position above the torso;

said raising comprises employing the stored energy to aid in raising the barbell back to the first position above the torso.

22. The method of claim 21 wherein the step of raising comprises positioning the axes of the sleeves in parallel first second planes extending along opposite sides of the torso section, the first second planes being generally perpendicular to an underlying surface when the a wearer is lying on an underlying surface, and positioning the axes of the sleeves in a second third plane defining an angle between 65-80° to the underlying surface and perpendicular to the first second planes wherein, in a bench press, the movement through from said second third plane to said first parallel planes plane allows a back arching movement by a lifter to place the sleeve axes perpendicular to the underlying surface in an essentially unstressed condition of the sleeves, whereby said lowering and raising steps comprises a bench press movement.

23. An atmospherically open tight fitting weight lifter's shirt as claimed in claim 21, wherein each sleeve has a length that approximately extends from the torso section to about the elbow of the weight lifter when worn.

24. The weight lifter's shirt of claim 21 wherein each sleeve, when said torso section is in a relaxed flattened condition, comprise a proximal section adjacent the torso section extending perpendicularly away from the torso section, the proximal sections of the sleeves being parallel.

* * * * *